US005927932A

United States Patent [19]

Seaberg

[11] Patent Number: 5,927,932

[45] Date of Patent: Jul. 27, 1999

[54] CLAMP ASSEMBLY WITH AUTOMATIC ROTATION CONTROL

[75] Inventor: Richard D. Seaberg, Brush Prairie, Wash.

[73] Assignee: Cascade Corporation, Portland, Oreg.

[21] Appl. No.: 08/956,695

[22] Filed: Oct. 24, 1997

[51] Int. Cl.[6] ..... B66F 9/12

[52] U.S. Cl. ..... 414/620; 414/621; 414/911

[58] Field of Search ..... 414/620–623, 414/910, 911

[56] References Cited

U.S. PATENT DOCUMENTS

| | | | |
|---|---|---|---|
| 2,754,018 | 7/1956 | Schroeder | 414/620 |
| 2,984,985 | 5/1961 | MacMillin | 414/620 X |
| 3,179,274 | 4/1965 | Comfort | 414/620 |
| 3,426,927 | 2/1969 | Woodward | 414/620 |
| 4,015,721 | 4/1977 | Scheler | 414/623 X |
| 4,161,256 | 7/1979 | Seaberg | 414/621 X |
| 4,177,000 | 12/1979 | Weinert et al. | 414/620 |
| 4,597,710 | 7/1986 | Kovats | 414/409 |
| 4,681,505 | 7/1987 | Kobayashi et al. | 414/910 X |
| 4,742,468 | 5/1988 | Ohashi et al. | 414/910 X |
| 5,281,076 | 1/1994 | Lehman | 414/620 X |
| 5,536,133 | 7/1996 | Velez et al. | 414/620 |

FOREIGN PATENT DOCUMENTS

| | | |
|---|---|---|
| 5-238685 | 9/1993 | Japan . |
| 5-238692 | 9/1993 | Japan . |

OTHER PUBLICATIONS

Auramo, "180° vs. 360° Rotation" (1995).

Cascade Corporation, "180° Stop Group," three pages (1982).

*Primary Examiner*—David A. Bucci

*Attorney, Agent, or Firm*—Chernoff, Vilhauer, McClung & Stenzel, LLP

[57] ABSTRACT

A rotatable load-handling clamp assembly has a rotation-stopping triggering assembly for automatically stopping clamp rotation at one or more predetermined stop positions. A hydraulic motor rotates a rotatable frame having clamp arms thereon with respect to a base. A hydraulic motor control system includes a switch and a set of triggering devices mounted in mutual opposition on the frame and base. The triggering devices are positioned to actuate the switch at the predetermined stop positions, and thereby automatically stop rotation of the hydraulic motor at such positions.

6 Claims, 5 Drawing Sheets

CLAMP ASSEMBLY WITH AUTOMATIC ROTATION CONTROL

BACKGROUND OF THE INVENTION

The present invention relates to improvements in clamping assemblies for picking up, transporting and stacking loads, particularly large rolls of paper such as newsprint and kraft paper, and other types of loads as well. More particularly, the invention relates to improvements in clamp assemblies capable of clamping a load and rotating it.

One typical function of a paper roll handling clamp is to rotate the paper rolls from the horizontal position to the upright position and vice versa. A problem is encountered in this operation because, unless the paper roll is either perfectly upright or perfectly horizontal, it is likely that an edge of the paper roll will be crushed when it is set down, resulting in economic loss.

A number of innovations have addressed this problem. One prior lift truck clamp assembly (a "90° rotation assembly") has a hard stop at a single precise horizontal position and at a single precise upright position, permitting a single 90° rotation between the two positions. One problem with such a limited 90° rotation arises from the fact that such clamp assemblies often have one pair of clamp arms which are comparatively short, and another pair of clamp arms which are comparatively long. If an upright paper roll is positioned relative to a wall, other paper rolls, or other physical obstacles on one side of the roll, it is more easily engaged or deposited with the clamp arm assembly rotated to a first upright position having the shorter clamp arms adjacent to the wall or other obstacle. Alternatively, if the obstacle is on the opposite side of the roll, the roll will be more easily engaged or deposited if the clamp arm assembly is rotated to a second upright position, 180° from the first position. Consequently, a 90° rotation assembly permitting only the first upright position is likely to encounter upright paper rolls positioned so that it is very awkward to engage or deposit them in the first upright position. Another problem encountered by a lift truck equipped with a 90° rotation assembly is that of driving obliquely on a sloped surface, such as a loading ramp. In this situation, it is desirable to cant the clamp arm assembly relative to an upright rotational position so that the paper roll will be level when it is deposited or engaged. With a 90° rotation assembly this is possible only if the desired cant is within the 90° range of rotation.

Another prior type of lift truck clamp assembly has hard stops at two upright positions 180° apart. This, however, does not enable the rotation of paper rolls automatically from a precise upright position to a precise horizontal position and vice versa, nor does it enable inversion of paper rolls horizontally.

Another disadvantage of the hard stop design is that these devices typically stop rotating with only minimal cushioning, causing the rotatable clamp assembly to undergo impact loads which may eventually damage the machinery.

There are also robotic designs for rotatable clamp assemblies in which any position of rotation may be programmed into an assembly controller. These devices, however, are generally computer controlled and are typically too expensive and delicate to be used economically in many load handling operations.

SUMMARY OF THE INVENTION

The present invention is an economical and reliable load-handling clamp assembly adapted to be mounted upon either a stationary or lift-truck mounted lifting apparatus and adapted to engage a load and rotate it into precise stop positions automatically.

The assembly includes a base adapted to be mounted upon the lifting apparatus, and a frame rotatably mounted on the base and driven by a linear or rotary hydraulic motor so as to rotate about an axis of rotation which may extend forwardly or in other directions, depending on the type of load being handled. Selectively openable and closeable opposing clamp arms project from the rotatable frame to grasp the load. A rotation control system is automatically actuated by a triggering assembly in response to rotation of the frame to one or more desired stop positions. A hydraulic valve assembly automatically responds to such actuation to stop the hydraulic motor precisely at the desired stop position or positions.

The triggering assembly preferably includes a switch and a set of triggering devices, corresponding to multiple automatic stop positions, mounted in mutual opposition on the base and the rotatable frame, respectively. Alternatively, the opposing positions of the switches and triggering devices could be reversed, and/or a set of switches could oppose a single triggering device, within the scope of the present invention. As used herein, the term "triggering assembly" is intended broadly to include any assembly capable of actuating a switch in response to relative movement between a triggering device and the switch which causes a predetermined proximity or contact between the two.

Preferably, there are at least three such stop positions, i.e., when the clamp arms are at a first upright position, at a second upright position rotated 180° from the first upright position, and in at least one horizontal position. Such an assembly enables precise automatic rotational positioning of the clamp arms whether they are upright or horizontal and whether they are in the first or second upright position. This prevents edge damage to the paper roll when it is set down, and aligns the clamp arms optimally to pick up rolls with the least clamping force to prevent damage from overclamping, regardless of the orientation of the roll.

Other separate aspects of the invention include operator-controlled override of one or more automatic stop positions, time-delayed override of one or more automatic stop positions, and/or automatic deceleration when approaching one or more automatic stop positions.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
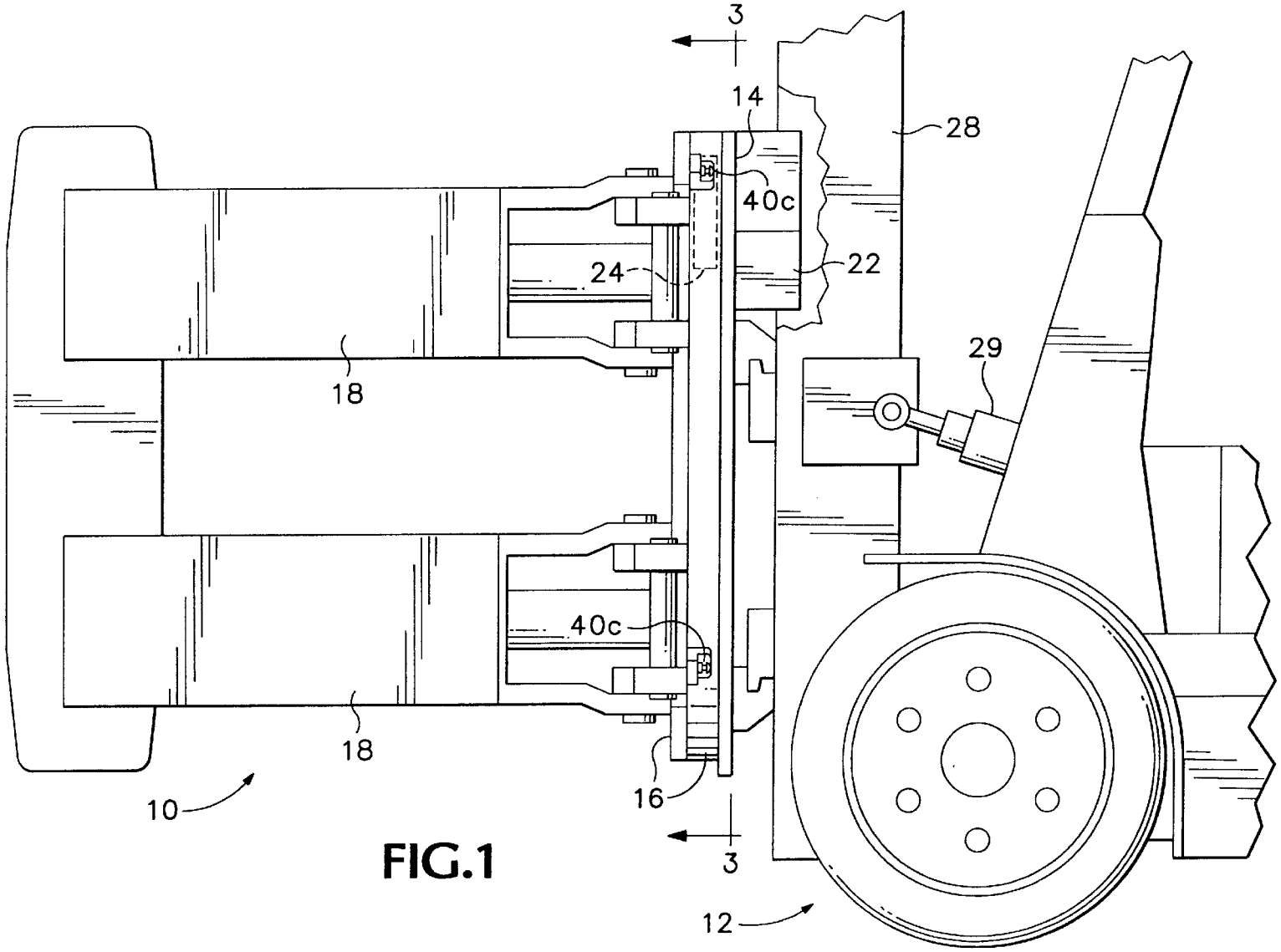
FIG. 1 is a simplified partial side view of a lift truck having an exemplary rotatable load clamp assembly on the front thereof rotated into an upright position.
Figure 2:
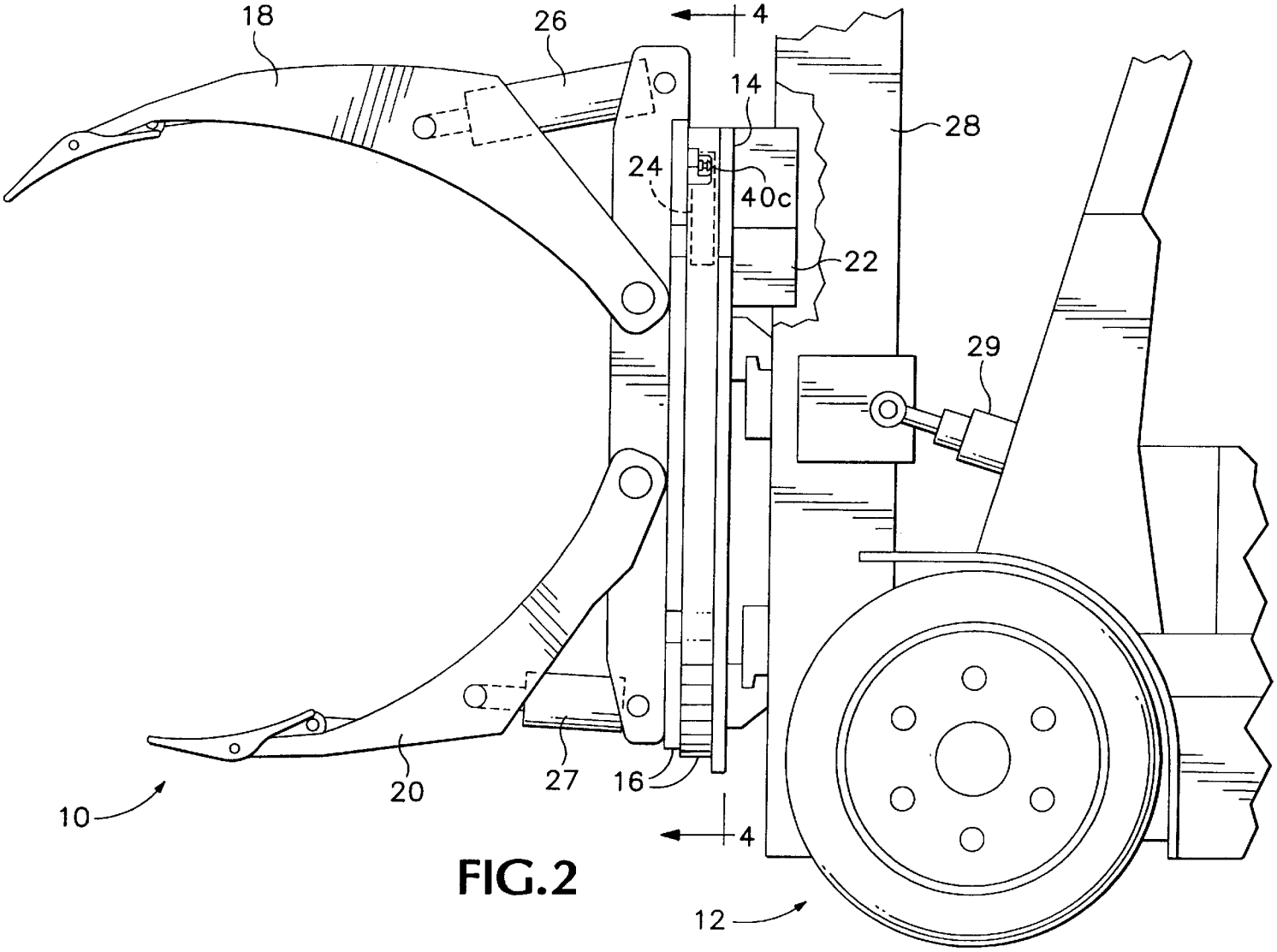
FIG. 2 is a partial side view of the lift truck and load clamp assembly of FIG. 1 with the load clamp assembly rotated into a horizontal position.
Figure 3:
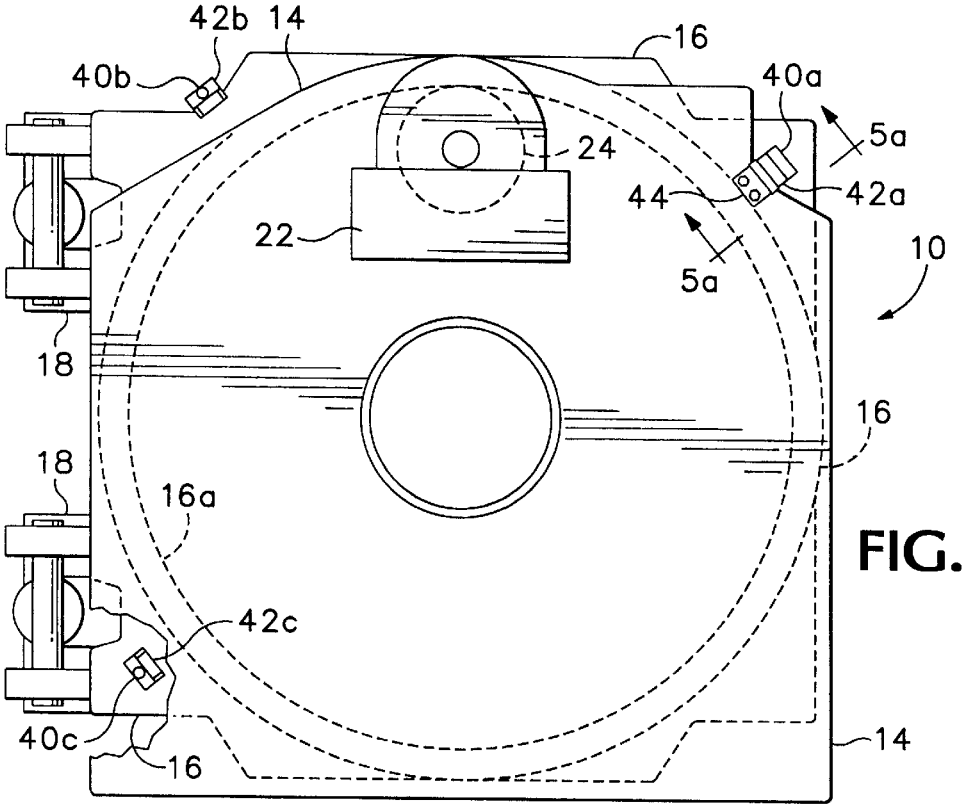
FIG. 3 is a rear view of the load clamp taken along line 3—3 of FIG. 1.
Figure 4:
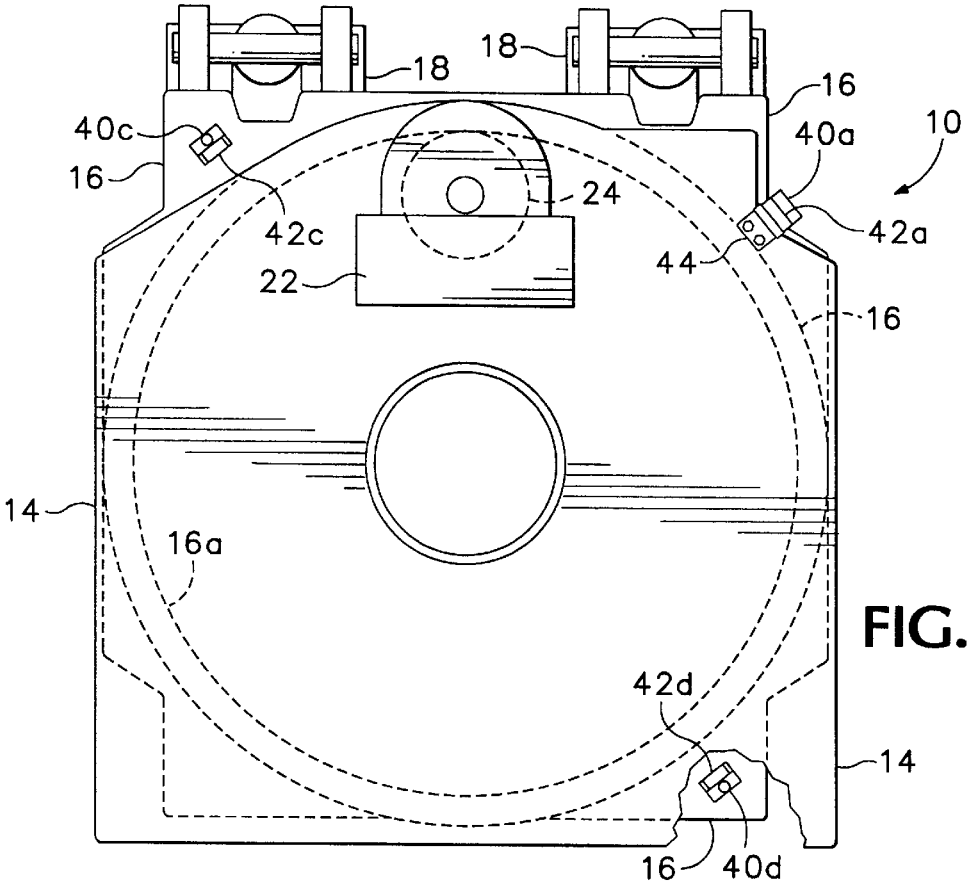
FIG. 4 is a rear view of the load clamp taken along line 4—4 of FIG. 2.

Referring to FIGS. 1 and 2, a clamp assembly 10 is attached to the front of a fork lift truck 12. A base 14 supports a rotatable frame 16, to which are attached a pair of long clamp arms 18 and a pair of short clamp arms 20. A bidirectional rotary hydraulic motor 22 rotates frame 16 by driving a pinion gear 24 with a conventional worm drive assembly (not shown), the pinion gear 24 engaging the interior of a ring gear 16*a* (FIG. 3) on the frame 16. Alternatively, a bidirectional linear hydraulic cylinder could serve as the motor to drive the pinion gear 24 through a toothed rack or chain. Respective sets of hydraulic cylinders 26, 27 open and close clamp arms 18 and 20. A lifting mast 28 selectively lifts assembly 10, and is selectively tiltable forwardly and rearwardly by tilt cylinders such as 29.

Clamp assembly 10 is specifically adapted to the handling of paper rolls. It is important, in this application, to rotate clamp arms 18 and 20 into the upright position shown in FIG. 1 so that paper rolls may be picked up or set down in a precisely upright position without edge damage. It is also important to rotate frame 16 into the precisely horizontal position shown in FIG. 2 to pick up and set down paper rolls in the horizontal position without edge damage. In addition, it is important to be able to rotate frame 16 180° from the upright position shown in FIG. 1, so that upright paper rolls which are located close to walls or other obstacles may be engaged with short clamp arms 20 adjacent to such wall or obstacle, regardless of whether located on the right or left side of the paper roll, to facilitate engagement of the roll.

Referring to FIGS. 3, 4, 5*a*, 5*b*, 6*a* and 6*b*, these clamp positions are achieved automatically by a triggering assembly which is part of an automatic rotation control system. Such triggering assembly preferably has a rotation-stopping switch 40*a* and a rotation-slowing switch 42*a* mounted by a switch bracket 44 to base 14. Rotation-stopping switch 40*a* is actuated by three triggering devices in the form of cams 40*b*, 40*c* and 40*d*, spaced 90° apart on the rotatable frame 16 for positioning clamp arms 18 and 20 at a horizontal position and at either one of the two possible upright positions. In similar manner, rotation-slowing switch 42*a* is actuated by three triggering devices in the form of cams 42*b*, 42*c* and 42*d*, spaced 90° apart. Switch 42*a* slows down the movement of frame 16 in a range about both sides of each stopping position to avoid shock-loading the system when switch 40*a* stops the movement of frame 16. Instead of cams, other types of triggering devices could be used, such as magnetic or optical proximity triggering devices.

Figure 7:
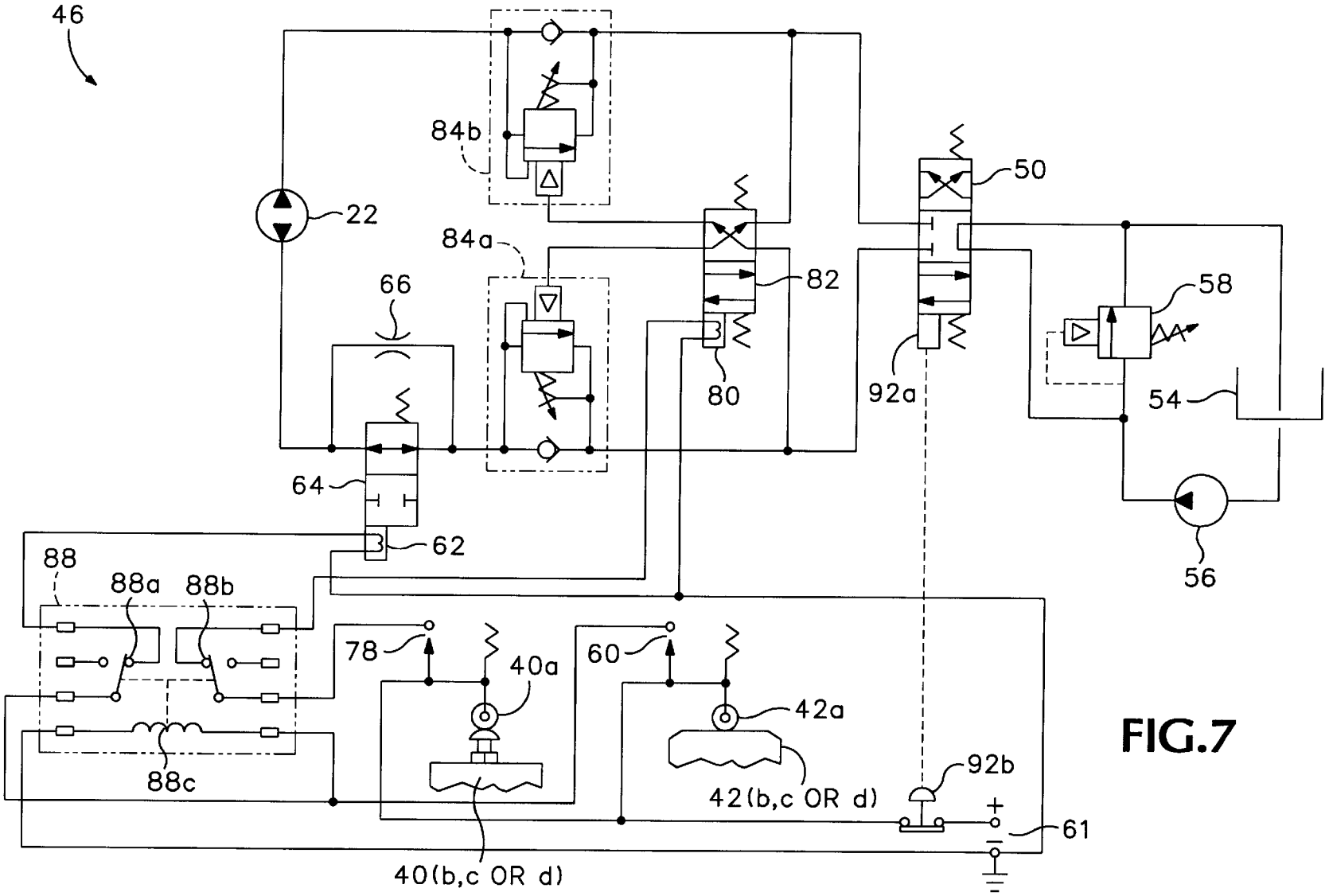
FIG. 7 is a schematic drawing of an exemplary fluid power circuit constructed in accordance with the present invention for controlling a load clamp of the type exemplified by FIG. 1.

Referring to FIG. 7, the hydraulic circuit 46 of assembly 10 includes a bidirectional manually-controlled hydraulic valve 50 that can rotate the hydraulic motor 22 in a first or second direction depending on the position of manually-controlled hydraulic valve 50, thus rotating the frame 16 to any position in a 360° range. A hydraulic fluid reservoir 54, and a hydraulic pump 56 with a hydraulic pressure relief valve 58, supply fluid to the valve 50.

Figure 6A:
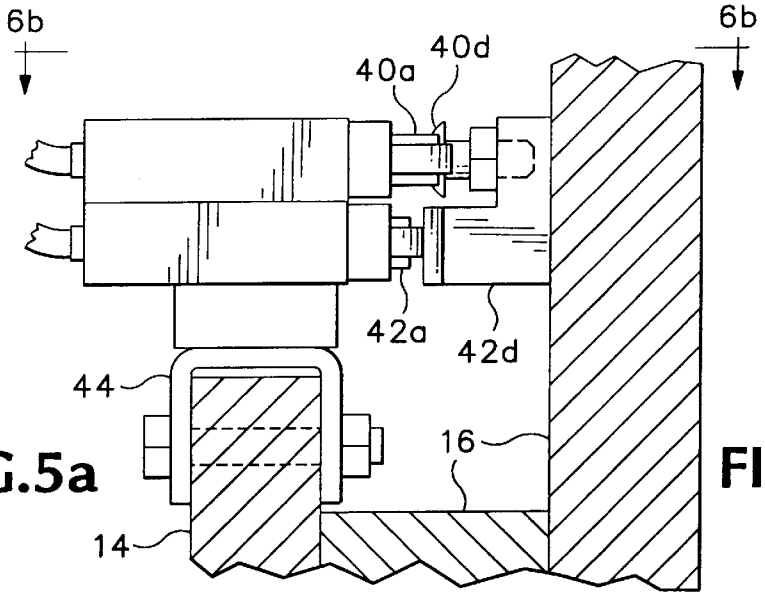
FIG. 6*a* is a view similar to FIG. 5*a*, but prior to the stop-actuating position.
Figure 6B:
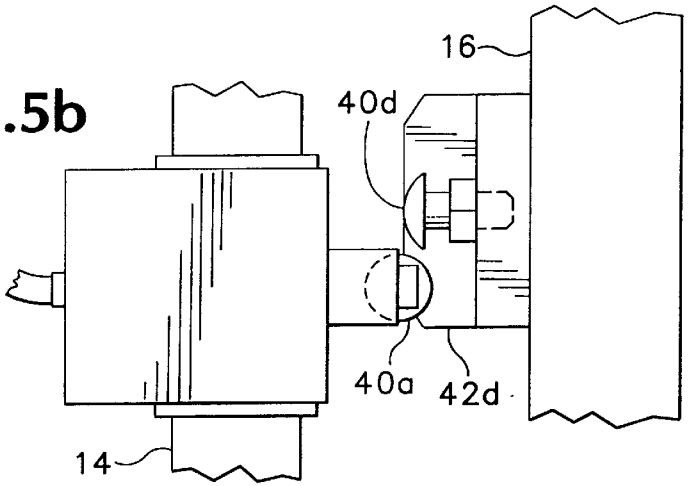
FIG. 6*b* is a top view taken along line 6*b*–6*b* of FIG. 6*a*.

When manually-controlled hydraulic valve 50 commands rotation of frame 16 in a first or second direction, motor 22 rotates frame 16 until rotation-slowing switch 42*a* of the automatic rotation control system is depressed by cam 42*b*, 42*c* or 42*d*, as shown with respect to cam 42*d* in FIGS. 6*a* and 6*b*. This closes a normally open rotation-slowing contact 60, permitting current to flow from a DC power source 61 through a normally closed relay switch 88*a* and a solenoid 62 of a rotation-slowing electrically activated hydraulic valve 64. This shuts off the flow of hydraulic fluid through valve 64 so that the hydraulic fluid flowing through the motor 22, regardless of its direction of rotation, must flow through a hydraulic flow restrictor 66, thereby slowing hydraulic motor 22.

Figure 5A:
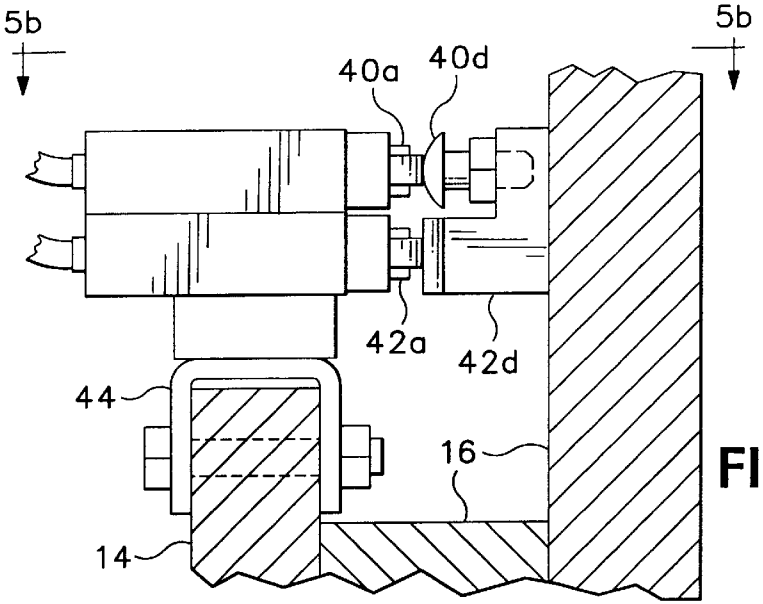
FIG. 5*a* is an enlarged cross-sectional view of a portion of the triggering assembly of the load clamp in a stop-actuating position, taken along line 5*a*–5*a* of FIG. 3.
Figure 5B:
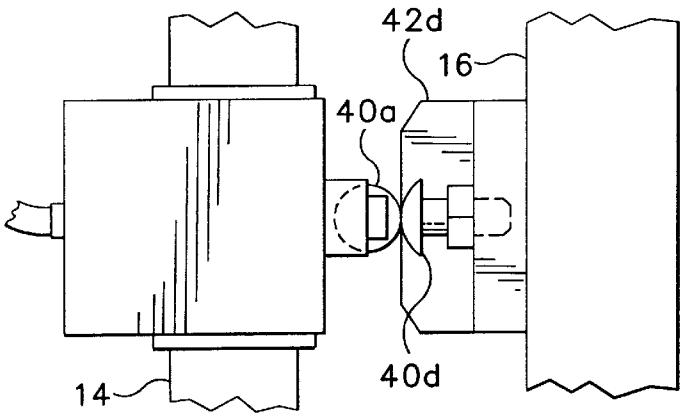
FIG. 5*b* is a top view taken along line 5*b*–5*b* of FIG. 5*a*.

When rotation-stopping switch 40*a* is thereafter depressed by cam 40*d* as shown in FIGS. 5*a* and 5*b*, normally open rotation-stopping contact 78 is closed, permitting current to flow through a normally closed relay switch 88*b* and the solenoid 80 of a rotation-stopping electrically activated hydraulic valve 82. The resulting actuation of valve 82 switches the hydraulic pilot pressure normally applied to the downstream counterbalance valve 84*a* or 84*b* (depending on the direction of rotation) from a high pressure, which normally holds the downstream valve 84*a* or 84*b* open during actuation of the valve 50, to a low pressure which closes the downstream valve 84*a* or 84*b*. This causes motor 22 to stop because fluid flow through the motor is blocked by the closure of valve 84*a* or 84*b*.

Timed dual relay 88 permits rotation of frame 16 to resume automatically after frame 16 has been slowed or stopped for about five seconds. This permits an operator to stop automatically at a stop point, pick up or set down a paper roll, and then resume rotation without having to override the automatic rotation control system manually. After rotation-slowing contact 60 has been switched closed for about 5 seconds, the magnetic field of winding 88*c* of the relay 88 will have developed sufficient field strength to cause relay switches 88*a* and 88*b* to open, thereby interrupting the flow of current through the solenoid valves 64 and 82 and restoring them to their normally unactuated conditions so that the motor 22 is controlled solely in response to manually-controlled valve 50. Thereafter, actuation of valve 50 rotates the motor 22 from the stop position, resulting in the opening of contacts 60 and 78 and the de-energizing of winding 88*c*, which permits relay switches 88*a* and 88*b* to return to their normally closed conditions in preparation for the approach of the next stop position.

Mounted on the manual control handle 92*a* of manual control valve 50 is an override button 92*b*, which alternatively permits the manual override of the automatic rotation control system. When override button 92*b* is depressed, the power source 61 is disconnected, thereby disabling the automatic rotation control system and allowing unrestricted rotation of the frame 16 through any stop position in any direction before any stopping occurs.

The assembly just described has a number of significant advantages over the prior art. Principally, without the need for expensive and delicate computerized controls, it can rotate 180° between a first precise upright stop position and an inverted second precise upright stop position, and it can also stop at a precisely horizontal position. As a result, it can precisely engage or deposit a horizontal paper roll or an upright paper roll, whether it is more easily manipulated in the first or second upright position. It can also selectively rotate it into the horizontal position, or into an inverted horizontal position, for movement by the lift truck and placement onto a paper dispensing apparatus with the proper unwinding orientation. Also, it can be canted with respect to any stop position in either rotational direction, so that the paper roll may be engaged or deposited in a proper attitude even if the lift truck is travelling obliquely along a loading ramp.

Moreover, override button 92*b* allows frame 16 to be rotated without interruption past any of the cam stop positions, so that the operator need not be delayed by having the frame stop. In addition, dual relay 88 permits an operator to rotate frame 16 to a desired cam stop position, engage or disengage a paper roll and then resume rotation of frame 16 without needing to manually override the automatic rotation control system. Each of these latter features, as well as the automatic stop and rotational inversion capabilities, increases the speed of the paper roll handling operation.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A load-handling clamp assembly adapted to be mounted upon a lifting apparatus and adapted to engage and rotate a load, said clamp assembly comprising:

(a) base adapted to be mounted upon said lifting apparatus;

(b) a rotatable frame mounted on said base;

(c) first and second selectively openable and closeable opposing clamp arms mounted upon said rotatable frame and projecting therefrom;

(d) a hydraulic motor adapted to rotate said rotatable frame with respect to said base about an axis of rotation; and (e) a rotation control system, including:

(i) a triggering assembly, comprising at least one switch and at least one triggering device mounted in mutual opposition on said base and said frame, at least one of said switch and triggering device being provided in sufficient number and locations to actuate said rotation control system automatically in response to rotation of said frame to any one of a first upright clamp arm stopping position, a second upright clamp arm stopping position rotated 180° from said first upright clamp arm stopping position, and at least one horizontal clamp arm stopping position, all of said stopping positions co-existing as predetermined stopping positions; and (ii) a hydraulic valve assembly operatively connected to said hydraulic motor and adapted to stop said hydraulic motor in response to actuation of said rotation control system by said triggering assembly.

2. The load-handling clamp assembly of claim 1 in which said triggering assembly comprises a switch and at least three triggering devices.

3. A load-handling clamp assembly adapted to be mounted upon a lifting apparatus and adapted to engage and rotate a load, said clamp assembly comprising:

(a) a base adapted to be mounted upon said lifting apparatus;

(b) a rotatable frame mounted on said base;

(c) first and second selectively openable and closeable opposing clamp arms mounted upon said rotatable frame and projecting therefrom;

(d) a hydraulic motor adapted to rotate said rotatable frame with respect to said base about an axis of rotation; and (e) a rotation control system, including:

(i) a triggering assembly, comprising at least one switch and at least one triggering device mounted in mutual opposition on said base and said frame, adapted to actuate said rotation control system automatically in response to rotation of said frame to at least one predetermined frame position;

(ii) a hydraulic valve assembly operatively connected to said hydraulic motor and adapted to stop said hydraulic motor in response to actuation of said rotation control system by said triggering assembly; and (iii) an automatically time-delay-activated override mechanism adapted to permit rotation of said frame from said predetermined frame position by overriding said actuation of said rotation control system by said triggering assembly automatically after a period of time has passed since said actuation has occurred.

4. A load-handling clamp assembly adapted to be mounted upon a lifting apparatus and adapted to engage and rotate a load, said clamp assembly comprising:

(a) a base adapted to be mounted upon said lifting apparatus;

(b) a rotatable frame mounted on said base;

(c) first and second selectively openable and closeable opposing clamp arms mounted upon said rotatable frame and projecting therefrom;

(d) a hydraulic motor adapted to rotate said rotatable frame with respect to said base about an axis of rotation; and (e) a rotation control system, including:

(i) a triggering assembly, comprising at least one switch and at least one triggering device mounted in mutual opposition on said base and said frame, said switch and triggering device being provided in sufficient number and location to actuate said rotation control system in response to rotation of said frame to at least a first predetermined frame position and a second predetermined frame position; and (ii) a hydraulic valve assembly operatively connected to said hydraulic motor and adapted to slow said hydraulic motor in response to actuation of said rotation control system by said triggering assembly at said first predetermined frame position, and to stop hydraulic motor in response to actuation of said rotation control system by said triggering assembly at said second predetermined frame position.

5. A load-handling clamp assembly adapted to be mounted upon a lifting apparatus and adapted to engage and rotate a load, said clamp assembly comprising:

(a) a base adapted to be mounted upon said lifting apparatus;

(b) a rotatable frame mounted on said base;

(c) first and second selectively openable and closeable opposing clamp arms mounted upon said rotatable frame and projecting therefrom;

(d) a hydraulic motor adapted to rotate said rotatable frame with respect to said base about an axis of rotation; and (e) a rotation control system, including:

(i) a triggering assembly, comprising at least one switch and at least one triggering device mounted in mutual opposition on said base and said frame, adapted to actuate said rotation control system automatically in response to rotation of said frame to at least one predetermined frame position; and (ii) a hydraulic valve assembly operatively connected to said hydraulic motor and adapted to stop said hydraulic motor, and thereby stop rotation of said frame along a direction of rotation, at said predetermined frame position in response to actuation of said rotation control system by said triggering assembly, and adapted thereafter to automatically enable said hydraulic motor to rotate said frame further along said direction of rotation beyond said predetermined frame position.

6. A load-handling clamp assembly adapted to be mounted upon a lifting apparatus and adapted to engage and rotate a load, said clamp assembly comprising:

(a) a base adapted to be mounted upon said lifting apparatus;

(b) a rotatable frame mounted on said base;

(c) first and second selectively openable and closeable opposing clamp arms mounted upon said rotatable frame and projecting therefrom;

(d) a hydraulic motor adapted to rotate said rotatable frame with respect to said base about an axis of rotation; and (e) a rotation control system, including:

(i) a triggering assembly, comprising at least one switch and at least one triggering device mounted in mutual opposition on said base and said frame, adapted to actuate said rotation control system automatically in response to rotation of said frame to at least one predetermined frame position;

(ii) a hydraulic valve assembly operatively connected to said hydraulic motor and adapted to stop said hydraulic motor in response to actuation of said rotation control system by said triggering assembly;

(iii) a control handle adapted to control said hydraulic motor and including a manually operated actuator mounted thereon; and (iv) an override mechanism responsive to said manually operated actuator and adapted to selectively permit rotation of said frame from said predetermined frame position by overriding said actuation of said rotation control system by said triggering assembly before said actuation has occurred.

* * * * *